United States Patent [19]

Hayashi

[11] 4,389,170

[45] Jun. 21, 1983

[54] ROTARY VANE PUMP WITH PASSAGE TO THE ROTOR AND HOUSING INTERFACE

[75] Inventor: Kazuo Hayashi, Yokohama, Japan

[73] Assignee: Nissan Motor Co., Ltd., Yokohama, Japan

[21] Appl. No.: 206,931

[22] Filed: Nov. 14, 1980

[30] Foreign Application Priority Data

Nov. 17, 1979 [JP] Japan ..... 54-159666[U]

[51] Int. Cl.[3] ..... F01C 1/00; F01C 21/04; F04C 29/02

[52] U.S. Cl. ..... 418/15; 418/100; 418/102

[58] Field of Search ..... 418/15, 97–100, 418/102, 259, 270

[56] References Cited

U.S. PATENT DOCUMENTS

| | | | |
|---|---|---|---|
| 2,816,702 | 12/1957 | Woodcock | 418/99 |
| 3,560,120 | 2/1971 | Gannaway et al. | 418/84 |
| 4,279,578 | 7/1981 | Kim et al. | 418/97 |

FOREIGN PATENT DOCUMENTS

| | | |
|---|---|---|
| 1553022 | 6/1979 | Fed. Rep. of Germany . |
| 47-22036 | 6/1972 | Japan . |

*Primary Examiner*—John J. Vrablik
*Assistant Examiner*—Jane E. Obee
*Attorney, Agent, or Firm*—Thompson, Birch, Gauthier & Samuels

[57] ABSTRACT

A passage leads from a high pressure discharge zone of a vane pump to an interface defined between the surface of the rotor of the pump and an arcuate contact surface formed in the inner wall of the pump housing to supply fluid under pressure to the interface for lubricating same.

5 Claims, 5 Drawing Figures

ROTARY VANE PUMP WITH PASSAGE TO THE ROTOR AND HOUSING INTERFACE

BACKGROUND OF THE INVENTION

1. Field of the Invention

The present invention relates to a vane pump and more particularly to an improved vane pump featuring an efficient sealing interface between the induction and discharge zones.

2. Description of the Prior Art

In a known arrangement a vane pump rotor has been disposed within the pump housing a manner such as to establish a seal in the form of a line contact between the high pressure discharge zone and the low pressure induction zone of the pump. However, this line contact has for various reasons failed to provide an efficient seal, thus reducing the efficiency of the pump. In another known arrangement, a surface-to-surface contact between the rotor and the housing, has been provided but this has led to relatively large frictional losses, again impairing the efficiency of the pump.

SUMMARY OF THE INVENTION

The present invention features a surface-to-surface seal between the high pressure discharge zone and the low pressure induction zone of a vane pump which is lubricated by the medium fluid pressurized through a passage or passages leading from the high pressure zone and which terminate at the surface-to-surface contact interface defined between the rotor and the rotor housing to provide pressurized lubrication thereat, the pressure of which is proportional to the discharge pressure. This provides a wide, well lubricated sealing interface which inherently increases the efficiency and life of the pump. The invention further features a unique reed valve which controls the discharge port of the pump and includes a projection or projections thereon which throttle the communication between the high pressure discharge zone and the surface-to-surface contact interface to proportion the pressure fed to the interface with respect to the discharge pressure.

BRIEF DESCRIPTION OF THE DRAWINGS

The features and advantages of the present invention will become more clearly appreciated from the following description of the drawings in which like reference numerals denote corresponding elements, and in which.

DETAILED DESCRIPTION OF THE PREFERRED EMBODIMENTS

Figure 1:
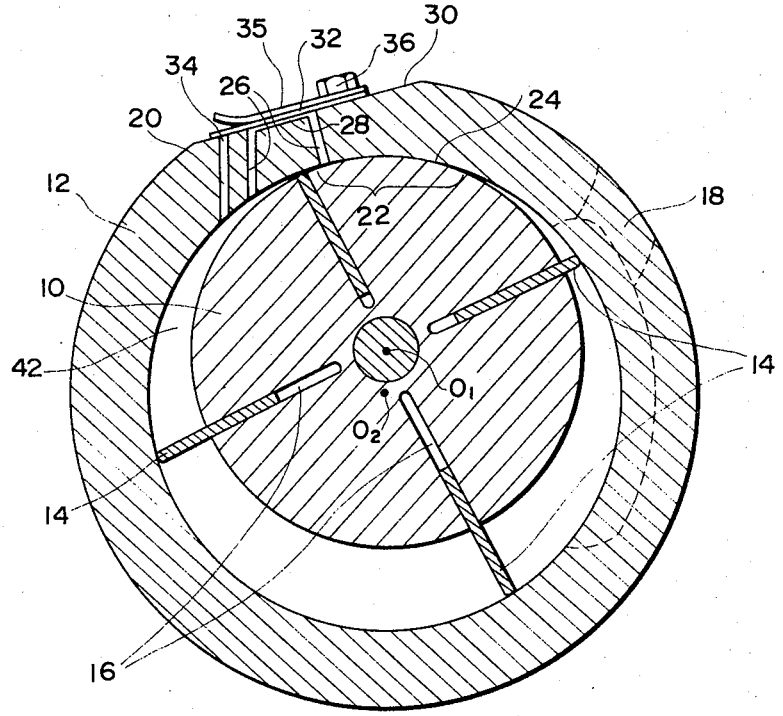
FIG. 1 is a sectional view of a vane pump according to the present invention.
Figure 2:
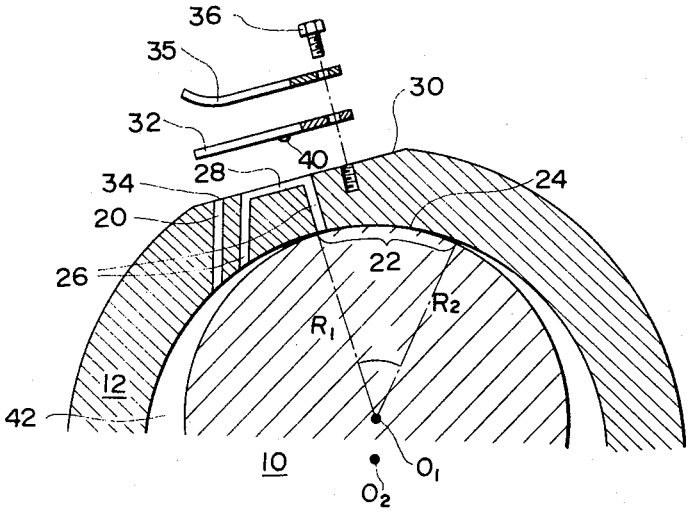
FIG. 2 is a view similar to FIG. 1 but showing the pump valve in exploded form.
Figure 4:
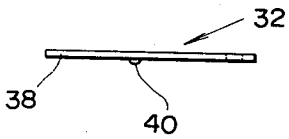
FIG. 4 is a side elevation of the valve element of the pump valve.
Figure 3:
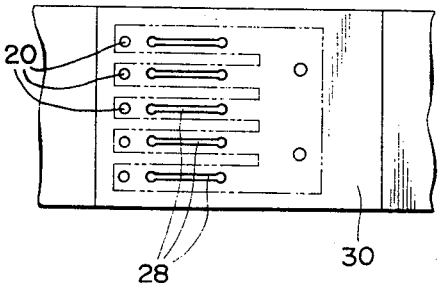
FIG. 3 is plan view of the valve mounting site.
Figure 5:
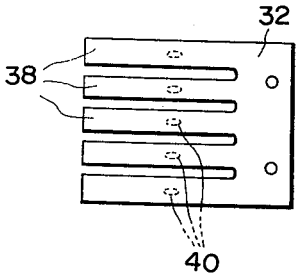
FIG. 5 is a plan view of the valve element shown in FIG. 4.

Turning now to the drawings and more specifically to FIGS. 1 and 2, a preferred embodiment of the present invention is shown. As best seen in FIG. 1, a rotor 10 is rotatably disposed within a housing 12 and arranged to rotate about an axis 01 which is offset from the center line 02 of the housing 12. A plurality of vanes 14 are slidably disposed in rotor grooves 16. An inlet or induction port 18 is formed through the wall of the housing 12. A plurality of discharge passages 20 are formed through the wall of the housing 12 as best shown in FIG. 3. Fluidly isolating the intake port 18 and the discharge passages 20 is a surface-to-surface contact interface 22, (see FIG. 2) defined between the rotor 10 and an arcuate contact surface 24 which has a radius of curvature R1 equal to the radius R2 of the rotor. The arcuate contact surface 24 thus compliments the surface of the rotor to define said surface-to-surface contact interface 22. Leading from the discharge or high pressure side of the interface is a plurality of passages 26 which terminate at the interface at a location adjacent the high pressure zone. Part of each of the passages 26 is defined by an open channel 28 (one for each passage) which extends along the pump valve mounting site 30. A valve element 32 which has a configuration clearly shown in FIGS. 4 and 5 is disposed as shown in FIG. 3 to cover the channels 28 and the outlet ports 34 of the discharge passages 20. A suitable limit 35 is placed on top of the valve element and the element and limit are secured to the mouting site 30 by screws 36. In this embodiment the valve element is formed to have a plurality of fingers or reeds 38 on the lower surfaces of which are formed projections 40 which each project into a channel 28 to throttle the communication between the high pressure discharge zone 42 and the interface 22.

The above described arrangement finds particular use as a refrigerant compressor of a refrigeration unit such as found in an automotive air conditioner wherein a refrigerant gas and a lubricant are introduced into the pump together.

In operation as the rotor 10 rotates the vanes slide out against the inner wall of the housing 12 under the influence of centrifugal force. Fluid (refrigerant and lubricant) is inducted through the intake port 18 and subsequently moved by the action of the vanes toward the discharge passages 20. Upon approaching the discharge pasages the fluid is compressed and subsequently forced into the discharge passages 20 and the passages 26. The reeds 38 are fixed to permit the discharge of the pressurized fluid through the discharge passages and depending upon the degree of flexibility of the limit 35 and projections are lifted slightly to reduce the throttling effect and accordingly permit an increased amount of pressurized fluid to reach the interface 22. Accordingly the amount of lubricant forced into this zone is increased to maintain an adequate seal despite the pressure prevailing in the high pressure zone. Naturally, as the rotational speed of the rotor increases the pressure prevailing in the high pressure zone will increase causing the reeds 38 to increase their degree of flexure. The combination of the channels, reeds and projections act to check the backflow of lubricant accumulated in the passages 26 downstream of the projections 40 ensuring a constant and adequate supply of lubricant at the sealing zone. As will be appreciated the lubricant is spread over the interface 22 by the rotation of the rotor 12. Further, a pressure gradient ranging from discharge pressure at the point of supply of lubricant from the passages 26 to induction pressure will exist across the interface in the direction of rotation of the rotor.

What is claimed is:

1. A rotary vane pump comprising:

a rotor disposed in a housing;

vanes slidably received in said rotor for contacting the inner surface of said housing;

an arcuate contact surface formed in said housing, said contact surface having a radius equal to the radius of said rotor, said rotor being mounted within said housing so as to contact said arcuate contact surface to define an interface between said housing and said rotor which separates a high pressure discharge zone on one side thereof from an induction pressure zone on the other side thereof;

a discharge passage leading from said high pressure discharge zone through the wall of the said housing;

a valve mounting site formed on said housing;

a discrete lubricant passage leading from said high pressure zone to said interface, said lubricant passage having an open channel section formed in said site;

a valve mounted on said site, said valve having an element for closing said channel; and a projection on said valve which extends into said lubricant passage for throttling the same in dependence on the pressure of the fluid discharged through said discharge passage.

2. In a rotary vane pump having a rotor disposed in a housing and vanes slidably received in said rotor for contacting the inner surface of said housing, an arcuate contact surface formed in said housing, said contact surface having a radius equal to the radius of said rotor;

said rotor being mounted within said housing so as to contact said arcuate contact surface at an interface between said housing and said rotor which separates a high pressure discharge zone on one side thereof from an induction pressure zone on the other side thereof;

a discharge passage leading from said high pressure discharge zone through the wall of said housing;

a reed valve for controlling fluid flow through said discharge passage;

a discrete lubricant passage leading from said high pressure zone to said interface; and a projection on said reed valve which extends into said lubricant passage for variably throttling the same in dependence on the pressure of the fluid discharged through said discharge passage and the degree of flexure of said reed valve, said projection preventing fluid in said lubricant passage between said projection and said interface from returning toward said high pressure discharge zone.

3. In a rotary vane pump having a rotor disposed in a housing and vanes slidably received in said rotor for contacting the inner surface of said housing, the combination of:

an arcuate contact surface formed in said housing having a radius equal to the radius of said rotor, said rotor being mounted within said housing so as to contact said arcuate contact surface to define an interface between said housing and said rotor which separates a high pressure discharge zone on one side thereof from an induction pressure zone on the other side thereof;

a discharge passage leading from said high pressure discharge zone through the wall of said housing;

a valve for controlling fluid flow through said discharge passage; and means defining a lubricant passage leading from said high pressure zone to said interface, wherein said housing includes a mounting site for said valve, and said lubricant passage includes an open channel portion formed in said site, said valve having an element closing said open channel and a projection which projects into said channel to throttle the communication between said high pressure zone and said interface.

4. A combination as claimed in claim 3, wherein said valve takes the form of a reed fastened to said mounting site and which is flexed in a direction to withdraw said projection from said channel by the discharge of pressurized fluid through said discharge passage.

5. A combination as claimed in claim 4, further comprising a limit disposed on top of said valve element to reduce the degree of flexibility thereof.

* * * * *